US005749282A

United States Patent [19]

Brow et al.

[11] Patent Number: 5,749,282

[45] Date of Patent: May 12, 1998

[54] BUILDING PANEL WITH DOUBLE INTERLOCK JOINT AND INTERNAL GUTTER

[75] Inventors: Richard A. Brow, Bethel Park; Robert I. Hossli, Pittsburgh, both of Pa.

[73] Assignee: United Dominion Industries, Charlotte, N.C.

[21] Appl. No.: 496,364

[22] Filed: Jun. 29, 1995

[51] Int. Cl.[6] ..... E04H 1/00; E04H 3/00

[52] U.S. Cl. ..... 52/235; 52/236.9; 52/309.9; 52/309.11; 52/209; 52/302.1; 52/236.7

[58] Field of Search ..... 52/309.9, 309.1, 52/580, 588, 281, 283.3, 512, 573, 468, 235, 236.9, 236.7, 302.1, 302.3, 209

[56] References Cited

U.S. PATENT DOCUMENTS

| | | | |
|---|---|---|---|
| 3,372,520 | 3/1968 | Hensel | 52/483 |
| 3,535,844 | 10/1970 | Glaros | 52/595 |
| 3,557,509 | 1/1971 | Blaski | 52/489 |
| 3,777,430 | 12/1973 | Tischuk | 52/309 |
| 4,050,201 | 9/1977 | Hubbard et al. | 52/209 X |
| 4,055,923 | 11/1977 | Biebuyck | 52/209 X |
| 4,123,885 | 11/1978 | Scott | 52/483 |
| 4,304,083 | 12/1981 | Anderson | 52/509 |
| 4,361,351 | 11/1982 | Ping | 52/309.9 |
| 4,448,001 | 5/1984 | Whitmyer et al. | 52/209 |
| 4,765,107 | 8/1988 | Ping | 52/235 |
| 4,840,004 | 6/1989 | Ting | 52/235 |
| 4,924,647 | 5/1990 | Drucker | 52/235 |
| 5,218,798 | 6/1993 | Bentivegna et al. | 52/209 X |
| 5,247,770 | 9/1993 | Ping | 52/309.9 |

*Primary Examiner*—Carl D. Friedman
*Assistant Examiner*—W. Glenn Edwards
*Attorney, Agent, or Firm*—Reed Smith Shaw & McClay LLP

[57] ABSTRACT

A building panel particularly adapted for horizontal application. The panel presents inner and outer male connectors at the upper edge of the panel, and complimentary inner and outer female connectors at the lower edge of the panel. Gutter means is provided along the upper edge of the panel intermediate of the male connectors. At the opposite ends of the panel, the outer facing sheet presents inturned end portions. Beyond the inturned end portions the foam core and edges of the inner facing sheets are exposed. In a wall structure assembled from a plurality of the panels, horizontal joints between panels and vertical joints between the panel ends are presented. Gasket means is presented in the vertical joint and is configured so as to provide vertically extending discharge channels communicating with the gutter means. Liquids bypassing the outer seals at the joints collects in the gutter means and is directed to the vertical channels for discharge.

21 Claims, 5 Drawing Sheets

BUILDING PANEL WITH DOUBLE INTERLOCK JOINT AND INTERNAL GUTTER

BACKGROUND OF THE INVENTION

1. Field of the Invention

This invention relates to insulated building panels formed from a pair of metal skins and an interposed thermal insulating material, and more particularly to building panels having double tongue and groove elements providing a double interlock joint and having an internal gutter.

2. Description of the Prior Art

Insulated double skin building panels having tongue and groove elements along each of the opposite edges providing a double tongue and groove joint between adjacent panels are known in the art. See for example U.S. Pat. Nos. 3,535,844 (Glaros), 3,777,430 (Tischuk), 4,123,885 (Scott), 4,304,083 (Anderson) and 4,316,351 (Ting). Insulated double skin building panels having two tongues along one panel edge and two grooves along the opposite panel edge which also provide a double tongue and groove joint between adjacent panels are known in the art. See for example U.S. Pat. Nos. 3,372,520 (Hensel), 3,557,509 (Blaski) and 5,247,770 (Ting). The Hensel '520 and Blaski '509 panels are normally erected vertically and do not provide any means for removing water that bypasses the tongue and groove connection located adjacent to the exterior face of the wall structure. The Ting '770 panel may be erected vertically or horizontally and depend on the engagement between flared tips of male joint elements with mini-corrugations provided on the female joint elements to preclude water infiltration through the panel side joint.

An insulated building panel having conventional tongue and groove connectors along both longitudinal edges and which is particularly adapted for erection in a horizontal manner, is known in the art. See, for example, U.S. Pat. No. 4,765,107 (Ting). The Ting '107 wall panel system provides for vertical discharge of liquids through a vertical joint cavity but fails to identify the source of the liquid being discharged.

None of above-identified prior art provide an drainage system disposed internally of the building panels to preclude liquids from entering the building.

SUMMARY OF THE INVENTION

The principle object of this invention is to provide a building wall system having a liquid drainage system including horizontal and vertical elements for eliminating a liquid that bypasses outer seals.

Another object of this invention is to provide a building wall system having water tight vertical and horizontal joints.

The present invention provides a horizontal joint between upper and lower insulated building panels each comprising inner and outer facing sheets and a structural foam core adhesively connecting the facing sheets. The facing sheets of the lower panel present inner and outer male connectors while the facing sheets of the upper panel present complimentary inner and outer female connectors receiving the male connectors of the lower panel to form inner and outer joints. In accordance with the present invention, gutter means intermediate of the inner and outer male connectors of the lower panel are provided for eliminating liquids bypassing the outer joint. The gutter means extends substantially entirely the full length of the lower panel.

The present invention also provides a building wall assembled from individual panels supported on vertical columns, the panels present space-apart ends forming vertical wall joints at the vertical columns, and being connected at their side edges to form horizontal joints. Each of the wall panels comprise inner and outer facing sheets and a structural form core adhesively connecting the facing sheets. In accordance with the present invention, gutter means is provided intermediate of the inner and outer facing sheets of the lower panel for directing liquids bypassing the outer joint to the vertical wall joints. The gutter means extends substantially entirely the full length of the lower panel.

The present invention also provides a building wall assembled from individual panels supported on vertical columns. The panels have space-apart ends forming vertical wall joints at the vertical columns and which are connected at their side edges to form horizontal wall joints. Each of the wall panels comprises inner and outer facing sheets and a structural foam core adhesively connecting the facing sheets. In accordance with the present invention, the opposite ends of the outer facing sheets of the panels, terminate inturned end portions. The inturned end portion of adajcent panels being space-apart by a first dimension. The ends of the inner facing sheets of adjacent panels, terminate in edges that are space-apart by a second dimension which is greater than the first dimension. In accordance with this invention, gasket means is provided having an outer portion and an inner portion. The outer portion of the gasket means spans between and is sealingly engaged with the inturned portions of the outer facing sheet thereby providing an external vertical seal. The inner portion of the gasket means spans between and is captively retained between the inner facing sheets and the foam core. The gasket means cooperates with the panel ends to provide vertical liquid discharge channels.

BRIEF DESCRIPTION OF THE DRAWINGS

Referring to FIG. 1, there is illustrated an exterior wall structure 10 supported on a structural frame work including vertical columns 12. The wall structure 10 is assembled from individual panels 14 having adjacent panels ends 16, 18 forming a vertical joint 20 and being connected along the lower and upper side edges 22, 24 to form horizontal wall joint 26.

Referring to FIG. 2, the insulated building of panel 14 comprises inner and outer facing sheets 28, 30 and a structural foam core 32 filling the interior space of the building panel 14 and adhesively connecting the facing sheets 28, 30 to provide a structural panel. At the upper edge 22 of the building panel 14, the inner and outer facing sheets 28, 30 provide inner and outer male connectors or tongues 34, 36. At the lower edge 24 of the panel 14, the inner and outer facing sheets 28, 30 provide inner and outer female connectors 38, 40 adapted to receive the tongues 34, 36 of a subjacent building panel. As is illustrated FIG. 3. The inner and outer female connectors 38, 40 each receive a bead 42, 44 of sealant, such as a non-hardening butyl sealant. The beads 42, 44 of sealant are adapted to be penetrated by the tongues 34, 36 of a subjacent panel to form inner and outer seals as shown in FIG. 3.

Figure 1:
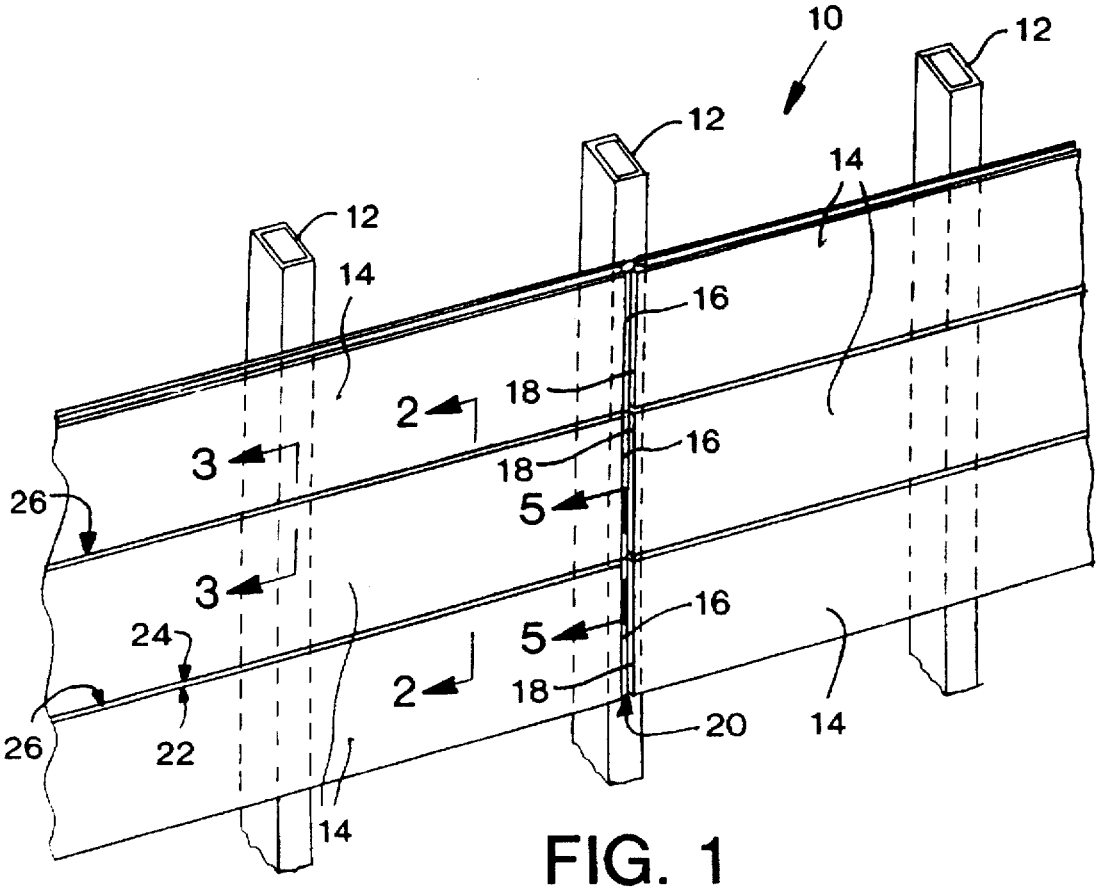
FIG. 1 is a fragmentary isometric view illustrating an exterior wall structure in a horizontal panel application in accordance with the present invention.
Figure 2:
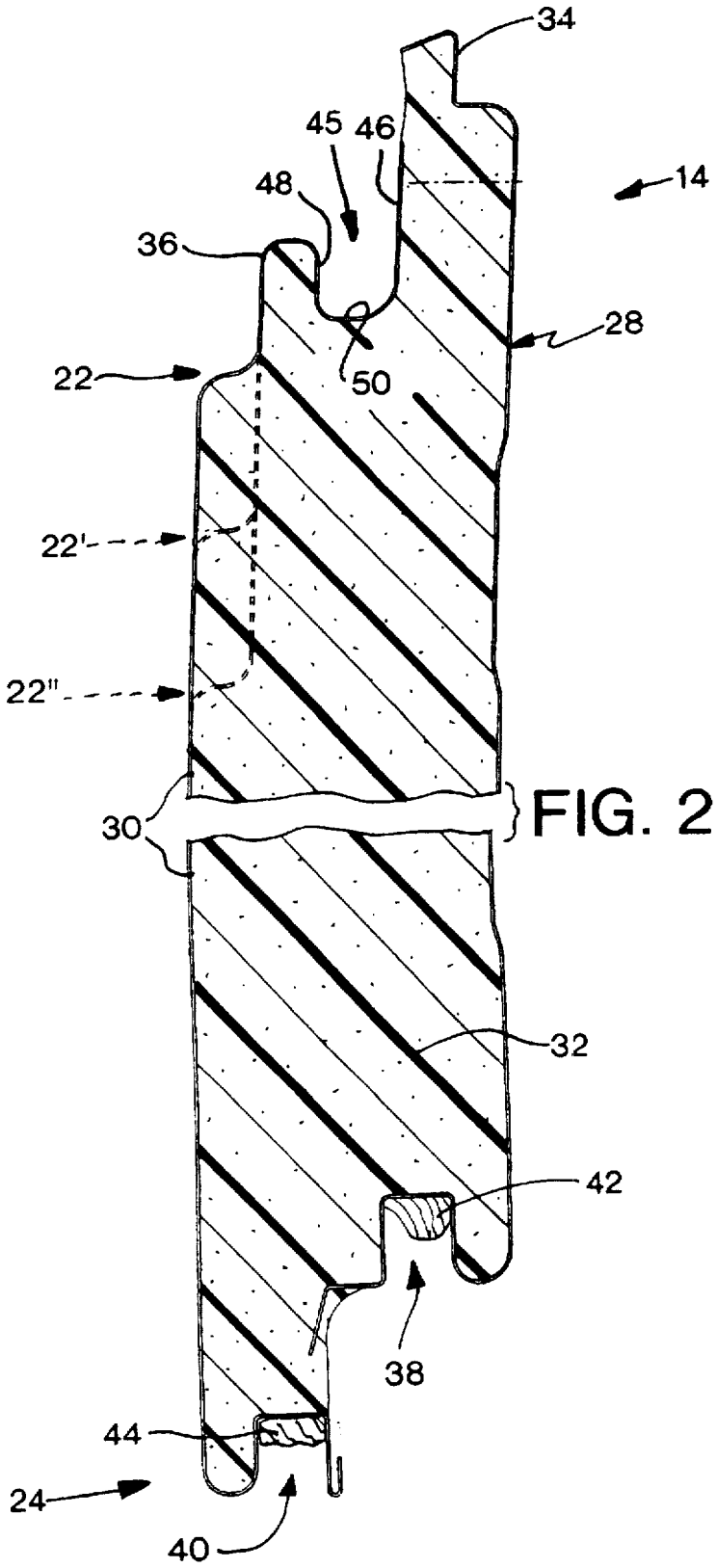
FIG. 2 is a broken cross-sectional view, taken along the line 2—2 of FIG. 1, illustrating the insulated building panel of the invention.

In accordance with the present invention, gutter means 45 is provided at the upper edge 22 of the building panel 14 and intermediate of the inner and outer tongues 34, 36. The gutter means extends substantially entirely along the full length of the building panel 14. As will be described, the gutter means serves to eliminate liquids bypassing the outer joint formed between the female connector 40 and the tongue of 36 of a subjacent building panels. The gutter means 45 has a generally U-shaped transverse profile including upstanding sides 46, 48 and a web of 50 connecting the sides 46, 48. As can be seen in FIG. 2, the side 48 of the gutter means 45 also constitutes a portion of the tongue 36. Therefore, the gutter means 45 is formed, in part, by the outer male connector or tongue 36.

Figure 3:
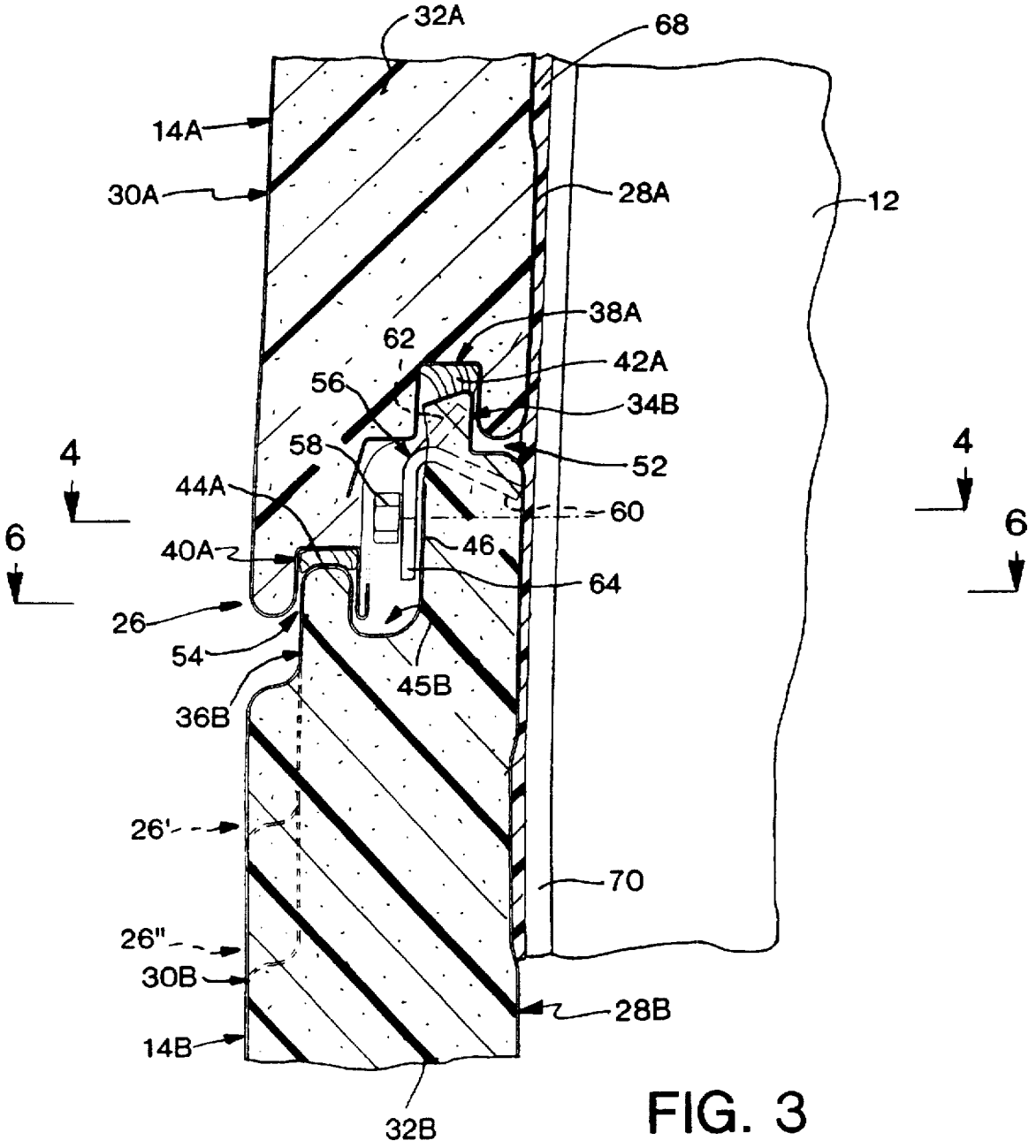
FIG. 3 is a cross-sectional view, taken along the line 3—3 of FIG. 1, illustrating the horizontal joint of this invention.
Figure 4:
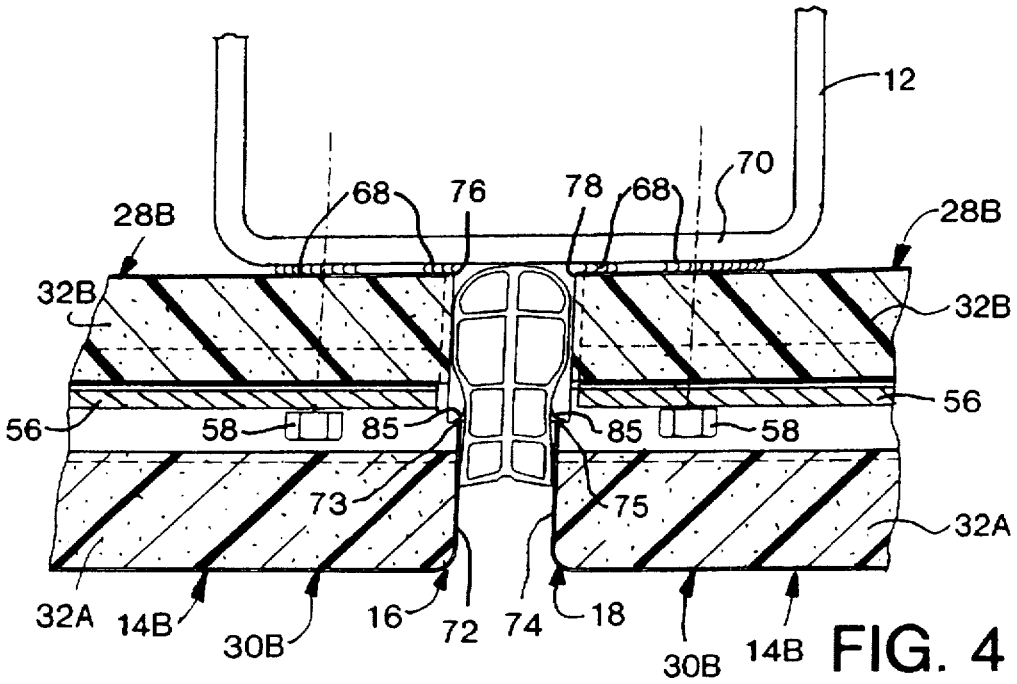
FIG. 4 is a cross-sectional view of the present horizontal building panel, as viewed from the line 4—4 of FIG. 3, illustrating the trimless end construction of the present panel.

Referring to FIG. 3, there is illustrated a horizontal joint 26 between upper and lower panels 14A, 14B. Comparing FIGS. 2 and 3, it will be observed that the location of the upper edge 22 may be varied, as shown at 22' and 22", and thus the width of the horizontal joint 26 may be varied as shown at 26' and 26". As can be seen in FIGS. 3 and 4, the lower building panel 14 is secured to the column 12 by a clip 56 and a fastener 58. As can be seen in FIG. 3, the clip includes a downturn central flange at 60 penetrating the foam core 32B and engaging the inner facing sheet 28B, and a pair of inclined flanges 62, only one visible in FIG. 3, penetrating the foam core 32B and extending into the tongue 34B. The clip 56 also has a main flange portion 64 which overlies the upstanding side 46 of the outer facing sheet 30B. The fastener 58 extends through the main flange portion 64, the upstanding side 46, the foam core 32B, the inner facing sheet 28B and into the vertical column 12. In this manner, both the inner and outer facing sheets 28B, 30B of the panel 14B are secured to the vertical column 12.

In order to provide further seals to preclude ingress of liquid into the interior of the building, multiple beads of a sealant 68 (FIG. 4) are applied along the entire length of the central web 70 of the column 12 and are engaged by all of the panels 14.

As can be seen in FIG. 4, the opposite ends 16, 18 of the panels 14B present inturned end portions 72, 74. Also at the opposite ends 16, 18 of the inner facing sheets 28B terminate in edges 76, 78, which are spaced from the inturned end portion 72, 74 so as to expose a face 80 of the foam core 32B.

Figure 5:
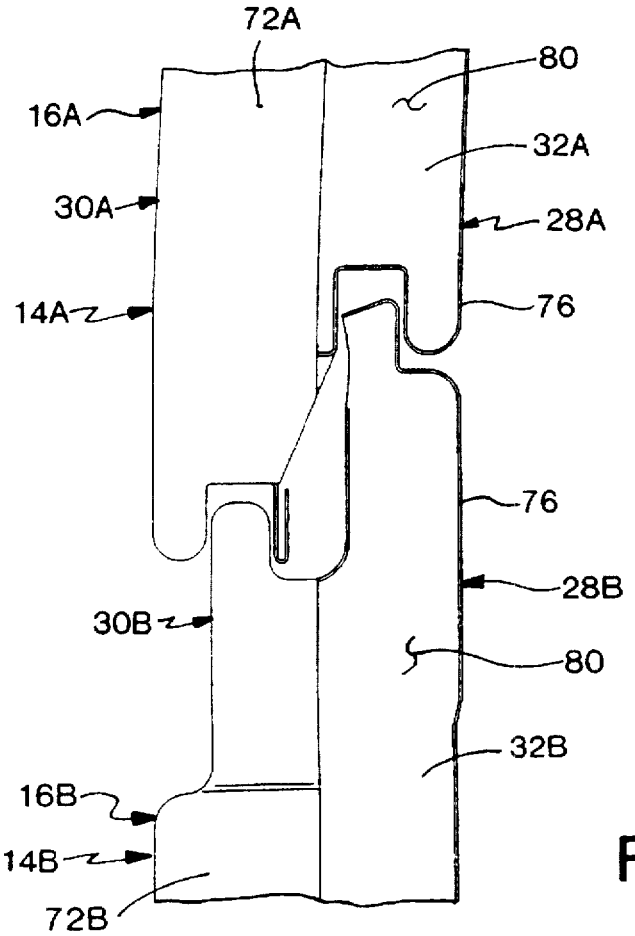
FIG. 5 is an end view of adjacent panels, as viewed from the line 5—5 of FIG. 1.
Figure 6:
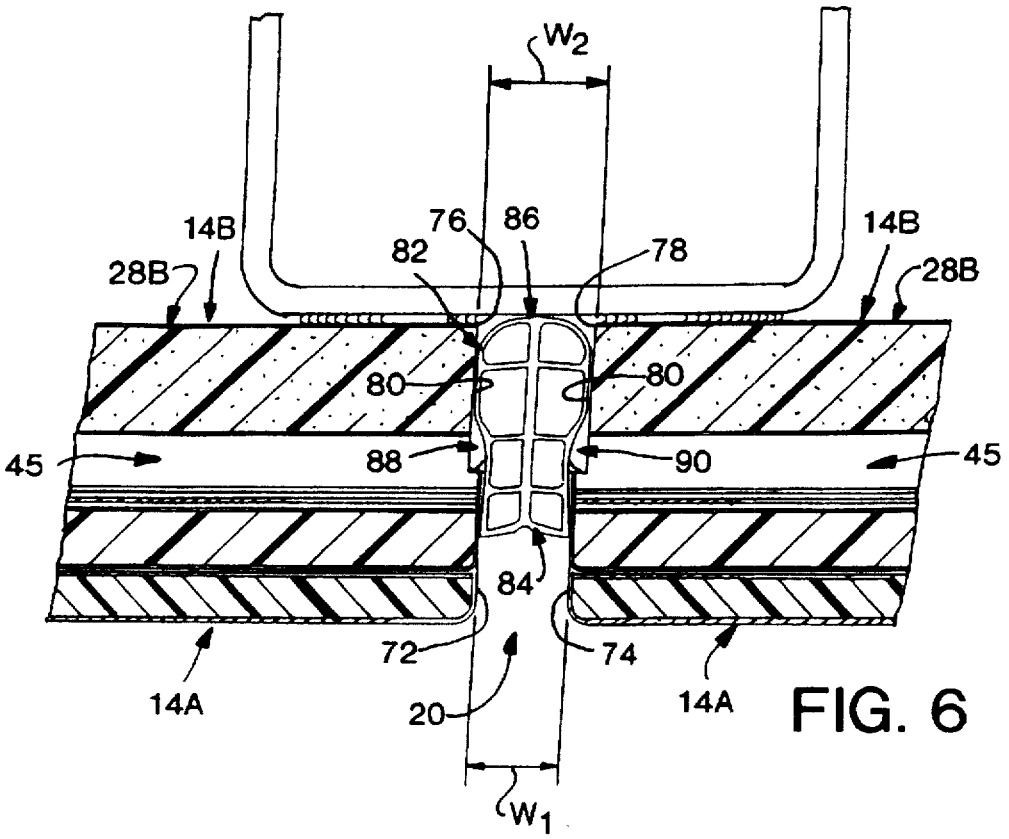
FIG. 6 is a cross-sectional view, taken the line 6—6 of FIG. 3, illustrating the horizontal gutter means and the vertical liquid discharge channels.

FIG. 5 illustrates the panel ends 16A, 16B of the panel members 14A, 14B. The inturned end portions 72A, 72B extend for a distance of approximately one-half the width of the foam panels 14A, 14B. Beyond the inturned end portions 72A, the face 80 of the foam core 32A, 32B and the edges 76 of the inner facing sheets 28A, 28B are exposed. At the vertical joint 20 (FIG. 6), the inturned end portions 72, 74 are spaced apart at a distance indicated by the dimension line $W_1$. In addition, the inner panel edges 76, 78 and the foam faces 80 are separated by a distance indicated at $W_2$. The dimension $W_2$ is greater than the dimension $W_1$.

Figure 7:
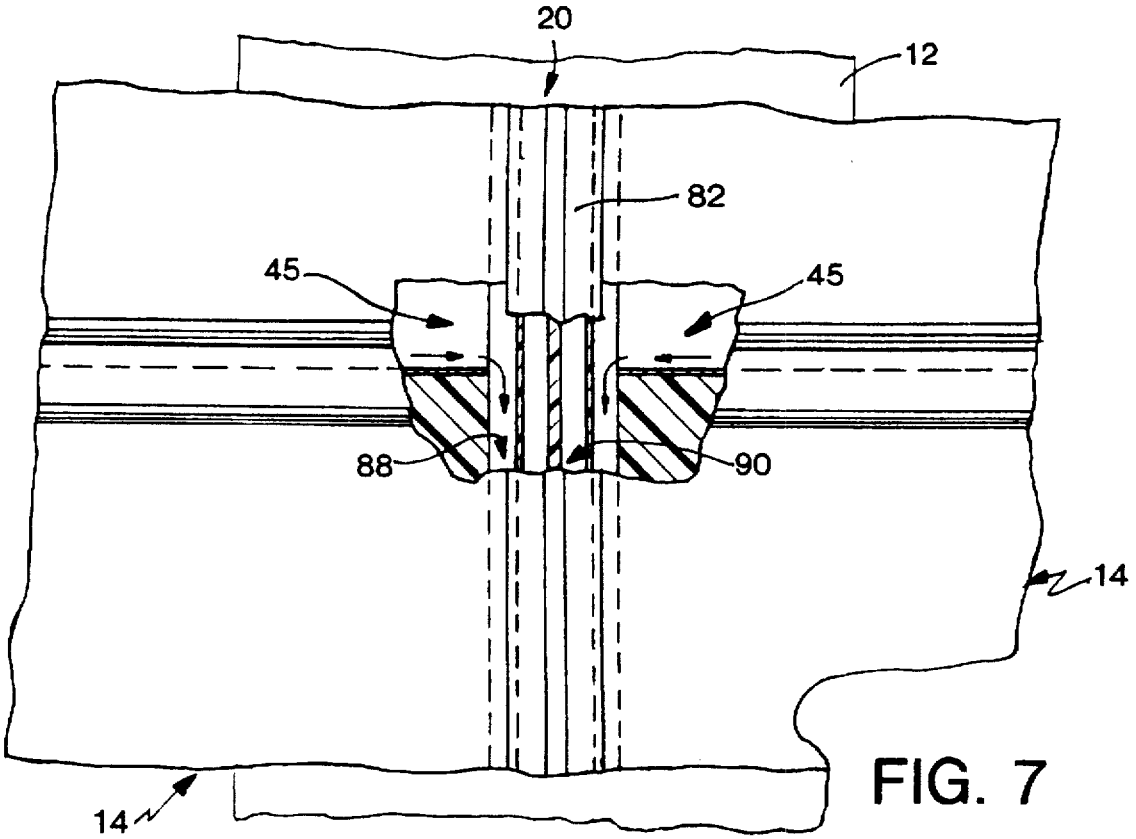
FIG. 7 is a front view of the vertical wall joint between the ends of adjacent insulated wall panels, with parts broken away to show detail.

Gasket means 82 is provided in the vertical joint 20. The gasket means 82 preferably is formed from flexible rubber to provide an efficient seal and to aid in the installation thereof. The gasket means 82 includes outer and inner portions 84, 86. The outer portion 84 spans the distance $W_1$ and is sealingly engaged with the inturned end portions 72, 74 of the outer facing sheets. The inner portion 86 includes retainer elements 85, 86 preferably extending along the entire length of the gasket means 82. The inner portion 86 spans the distance $W_2$, sealingly engages the foam faces 80, and has the retainer elements 85, 86 engaged with the inner edges 73, 75 of the inturned end portions 72, 74. The inner portion 86 is therefore captively retained between the adjacent panels 14B, 14B. Since the inner portion 86 is sealingly engaged with the face 80 of the exposed foam core 32B, liquids that bypass the sealant 44 in the outer joint 54 (FIG. 3), are precluded from reaching the bead 68 of sealant between the inner facing sheets 28 and the column 12 and degrading the same or bypassing the same in the event the beads 68 are incomplete. It will be observed in FIG. 6 that the shape of the gasket means 82 is such that vertical liquid discharge channels 88, 90 are provided that communicate with the gutter means of 45 of each of the panels 14 for eliminating liquids that bypass the sealant 44A (FIG. 3) of the outer joint 54. As can be seen in FIG. 7, liquids accumulating within the gutter means 45 flow laterally to the vertical discharge channels 88, 90 and drain downwardly through the channels 88, 90 to a suitable discharge point.

While the attached drawings illustrate the use of the present panel in a horizontal application, the present panel also finds utility in vertical application as well as a roof panel.

Although the invention has been described in detail for the purpose of illustration, it is to be understood that such detail is solely for that purpose and that variations can be made therein by those skilled in the art without departing from the spirit and scope of the invention except as it may be limited by the claims.

We claim:

1. A horizontal joint between upper and lower insulated building panels, each of said upper and lower insulated building panels comprising inner and outer facing sheets and a structural foam core adhesively connected with said facing sheets, wherein:

said inner and outer facing sheets of said lower panel respectively present inner and outer male connectors;

said inner and outer facing sheets of said upper panel respectively present inner and outer female connectors;

each of said inner and outer male connectors respectively extend into said inner and outer female connectors to respectively form inner and outer horizontal joints;

said joint further comprises gutter means for accommodating liquid that bypasses said outer joint and for diverting such liquid away from said inner horizontal joint;

said gutter means is disposed intermediately between said inner and outer male connectors;

said gutter means comprising at least opening for discharging liquid; and said gutter means comprising at least one liquid-accommodating portion in fluid communication with said at least one opening, said liquid-accommodating portion having a substantially unbroken cross-section configured for providing smooth and unimpeded drainage.

2. The horizontal joint according to claim 1, wherein said gutter means has an internal pressure being equalized with respect to ambient pressure.

3. The horizontal joint according to claim 1, wherein:

said gutter means comprises a substantially horizontal drain shelf for accommodating liquid that bypasses said outer joint and for diverting such liquid away from said inner horizontal joint;

said outer joint is disposed vertically above said horizontal drain shelf; and said gutter means extends along substantially entirely the full length of said panel.

4. The horizontal joint according to claim 3, wherein said gutter means is formed integrally with respect to said outer male connector of said lower facing sheet.

5. The horizontal joint according to claim 4, wherein:

said gutter means further comprises at least one wall portion extending from said horizontal drain shelf; and said at least one wall portion extending from said horizontal drain shelf comprises a portion of said outer male connector.

6. The horizontal joint according to claim 5, wherein said gutter means comprises a trough-like recess being indented into said structural foam core.

7. The horizontal joint according to claim 6, further comprising:

at least one compressible medium disposed in each of said inner and outer female connectors;

said inner and outer male connectors being embedded in said at least one compressible medium, to form inner and outer seals that ensure the internal pressure equalization of said gutter means.

8. The horizontal joint according to claim 7, wherein said at least one compressible medium comprises a non-hardenable sealant disposed in each of said inner and outer female connectors.

9. The horizontal joint according to claim 8, wherein said inner male connector is disposed vertically above said outer male connector, to prevent the accumulation of liquid between adjacent surfaces of corresponding ones of said male and female connectors.

10. The horizontal joint according to claim 1, wherein said inner male connector is disposed vertically above said outer male connector, to prevent the accumulation of liquid between adjacent surfaces of corresponding ones of said male and female connectors.

11. The horizontal joint according to claim 1, wherein:

said upper and lower panels each comprise spaced-apart ends for forming vertical joints when placed adjacent other building panels, each said end comprising means for forming at least a portion of a vertically extending liquid discharge channel and means for cooperating with an end of an adjacent building panel, such vertically extending liquid discharge channels for being in fluid communication with said gutter means to receive liquid from said gutter means and direct liquid away from said gutter means;

said ends of said panels each comprise gasket means for being disposed in vertical joints formed with other cooperating building panels, said gasket means each having an outer portion and an inner portion, said inner portion extending between said inner facing sheets; and each said gasket means being formed from a flexible, compressible material for compensating for changes in gap width with respect to neighboring, adjacent building panels.

12. The horizontal joint according to claim 11, wherein each said gasket means comprises a surface disposed adjacent the corresponding end of the corresponding panel, said surface combining with the corresponding end of the corresponding panel to form at least a portion of one of said vertically extending liquid discharge channels.

13. The horizontal joint according to claim 12, wherein said foam core is exposed at the edges of said inner facing sheets and is engaged by said gasket means while said gasket means is compressed against the exposed foam core, thereby sealing said ends of said panels and preventing the progression of liquid past said vertical joints.

14. The horizontal joint according to claim 13, wherein said inner facing sheets of said panels each terminate in inturned panel edges at said ends of said panels; and said outer portion of each of said gasket means extending between, and being sealingly engaged with, said inturned end portions.

15. A building wall assembled from individual panels supported on vertical columns, said building wall comprising:

said panels each comprising spaced-apart ends forming vertical joints with ends of horizontally adjacent building panels;

said panels each comprising upper and lower side edges forming horizontal joints with vertically adjacent building panels;

said panels each comprising inner and outer facing sheets and a structural foam core adhesively connected with said facing sheets;

gutter means disposed intermediately between said inner and outer facing sheets at said upper side edge of each of said panels, said gutter means comprising means for accommodating liquid that enters said horizontal joints and for diverting such liquid away from said horizontal joints;

vertically extending liquid discharge channels, disposed at said vertical joints, in fluid communication with said gutter means, said vertically extending liquid discharge channels comprising means for receiving liquid from said gutter means and directing liquid away from said gutter means;

said inner facing sheets lie along a given generally vertical plane;

gasket means disposed in at least one of said vertical joints, said gasket means having an outer portion and an inner portion, said inner portion having at least a portion extending inwardly at least into alignment with the plane defined along said inner facing sheets;

said gasket means being disposed to seal said ends of said panels and prevent the progression of liquid towards said inner facing sheets.

16. The building wall according to claim 15, wherein said gasket means are each formed from a flexible, compressible material for compensating for changes in gap width with respect to neighboring, adjacent building panels.

17. The building wall according to claim 16, wherein said foam core of each said panel is exposed at the edges of said inner facing sheets and is engaged by said gasket means as said gasket means is compressed against the exposed foam core, thereby sealing said ends of said panels and preventing the progression of liquid past said vertical joints.

18. The building wall according to claim 17, wherein:

each said gasket means comprises a surface disposed adjacent an end of an adjacent panel, said surface combining with the end of the panel to form at least a portion of at least one of said vertically extending liquid discharge channels.

19. The building wall according to claim 18, wherein:

said inner and outer facing sheets of each said panel respectively present, at said upper edge of each said panel, inner and outer male connectors;

said inner and outer facing sheets of said upper panel respectively present, at said lower edge of each said panel, inner and outer female connectors;

each of said inner and outer male connectors respectively extend into said inner and outer female connectors to respectively form inner and outer horizontal joints;

said gutter means being disposed intermediately between said inner and outer male connectors.

20. A building wall assembled from individual panels supported on vertical columns, said building wall comprising:

said panels each comprising spaced-apart ends forming vertical joints with ends of horizontally adjacent building panels;

said panels each comprising upper and lower side edges forming horizontal joints with vertically adjacent building panels;

said panels each comprising inner and outer facing sheets and a structural foam core adhesively connected with said facing sheets;

said outer facing sheets of said panels terminating in end portions at said vertical joint, said end portions being spaced-apart at a first width;

said inner facing sheets of said panels terminating in panel edges at said vertical joint, said panel edges of said inner facing sheets being spaced-apart at a second width that is greater than said first width;

each said end of said panels comprising means for forming at least a portion of a vertically extending liquid discharge channel and means for cooperating with an end of an adjacent building panel;

gasket means disposed in at least one of said vertical joints;

said gasket means comprising a surface disposed adjacent the corresponding end of the corresponding panel, said surface combining with the corresponding end of the corresponding panel to form at least a portion of one of said vertically extending liquid discharge channels;

said gasket means being formed from a flexible, compressible material for compensating for changes in gap width with respect to neighboring, adjacent building panels;

said gasket means comprising two portions, a first of said two portions extending between said outer edge portions and having at least one width corresponding to said first width, a second of said two portions extending between said inner panel edges and having at least one width corresponding to said second width; and at least one of said vertically extending liquid discharge channels being defined at least partly via the differential between said first and second widths.

21. The building wall according to claim 20, wherein said foam core of each said panel is exposed at the edges of said inner facing sheets and is engaged by said gasket means as said gasket means is compressed against the exposed foam core, thereby sealing said ends of said panels and preventing the progression of liquid past said vertical joints.

* * * * *